US006188372B1

(12) United States Patent
Jackson et al.

(10) Patent No.: US 6,188,372 B1
(45) Date of Patent: Feb. 13, 2001

(54) ANTENNA WITH MOLDED INTEGRAL POLARITY PLATE

(75) Inventors: Gordon Jackson; Wallace Abernethy, both of Clayton, NC (US)

(73) Assignee: Channel Master LLC, Smithfield, NC (US)

( * ) Notice: Under 35 U.S.C. 154(b), the term of this patent shall be extended for 0 days.

(21) Appl. No.: 09/335,089

(22) Filed: Jun. 17, 1999

(51) Int. Cl.[7] ..... H01Q 3/02
(52) U.S. Cl. ..... 343/882; 343/880
(58) Field of Search ..... 343/880, 881, 343/882, 760, 840, 861, 892, 894, 765, 766

(56) References Cited

U.S. PATENT DOCUMENTS

| | | | | |
|---|---|---|---|---|
| 4,404,565 | * | 9/1983 | Gurney et al. | 343/881 |
| 4,692,771 | * | 9/1987 | Rothbarth et al. | 343/882 |
| 4,860,021 | * | 8/1989 | Kurosawa et al. | 343/840 |
| 5,604,508 | * | 2/1997 | Atkinson | 343/879 |
| 5,734,356 | * | 3/1998 | Chang | 343/882 |
| 5,870,059 | * | 2/1999 | Reynolds | 343/760 |
| 5,929,817 | * | 7/1999 | Clark | 343/713 |

* cited by examiner

*Primary Examiner*—Don Wong
*Assistant Examiner*—Chuc D Tran
(74) *Attorney, Agent, or Firm*—Darby & Darby

(57) ABSTRACT

An antenna and mounting assembly permitting azimuth adjustment of antenna elevation and rotation of the antenna about a polarity axis includes a molded antenna having an integrally molded polarity plate formed on its back side. The polarity plate has a back planar surface perpendicular to the polarity axis and is configured to receive a mounting bracket. A suitable mounting bracket has a polarity portion and an elevation portion generally separated by a boundary line and being substantially perpendicular to each other. The polarity portion has a polarity slot in it and the elevation portion has an elevation mounting hole and an arcuate elevation slot lying along a circle having a center substantially corresponding to the position of the elevation hole. A first mounting member engages the mounting hole and polarity slot to secure the bracket to the polarity plate. The angle of rotation of the antenna about the polarity axis relative to the bracket can be adjusted by adjusting the position of the mounting member within the polarity slot. The bracket can be mounted to antenna azimuth clamp by a second mounting member which engages the elevation hole and a locking bolt which engages the elevation slot.

17 Claims, 17 Drawing Sheets

ANTENNA WITH MOLDED INTEGRAL POLARITY PLATE

FIELD OF THE INVENTION

This invention is related to an antenna dish having integrally molded elements which aid in mounting and proper antenna alignment.

BACKGROUND OF THE INVENTION

To use a parabolic satellite antenna, the antenna and its feed must be properly aligned with the satellite. Many satellite transmissions are polarized, and thus the antenna assembly must also be rotated to the proper polarity orientation. A simple parabolic antenna is configured such that the central axis of the parabola passes through the center of the dish. Once the antenna is aimed at the satellite, it may be rotated around this axis to adjust the polarity without losing the satellite alignment. As can be appreciated, however, because the parabolic axis is centrally located, the feed must be centrally positioned in front of the antenna. This configuration blocks a portion of the signal and results in a performance degradation.

To address this problem, many parabolic antennas are designed so that the parabolic vertex is near or at the antenna's lower edge. Antennas of this type are commonly referred to as offset parabolic antennas, since the feed is offset from the antenna edge, thus reducing the signal blockage. Such an antenna arrangement 10 is illustrated in FIG. 1. As shown, a parabolic antenna 12 has a vertex 14 which is adjacent its lower edge 16. A line 18 running between the vertex 14 and the focal point 20 defines a boresight to the satellite. A feed horn 22 is mounted at the focal point 20 and directed toward the dish 12 to receive reflected energy. The antenna dish 12 is mounted on an antenna mount 24. For reasons of balance, antenna mount 24 is generally attached to antenna 12 at or near the middle of the antenna.

The mount 24 is configured to allow the azimuth elevation of the antenna to be adjusted. In addition, the mount 24 is configured to allow the antenna to be rotated about a polarity axis 26 which is parallel to the boresight axis 18. The polarity axis is shifted from the perpendicular relative to the antenna attachment points. Thus, the mount 24 must be configured with this angular deviation in mind.

FIGS. 2*a* and 2*b* are side and back views, respectively, of a conventional mounting assembly 24. To compensate for the fact that the vertex of the antenna 12 is not centrally located, a separately mounted polarity plate 30 is provided. Polarity plate 30, generally formed using stamped steel, affixed to a predetermined location in the back of the antenna 12 after the antenna is manufactured, e.g., by means of bolts 31. As can be appreciated, both the boresight axis 18 and the polarity axis 26 are perpendicular to a polarity plane 28. The polarity plate 30 has a flat back plane 32 and is dimensioned such that when the plate 30 is bolted to the back of antenna 12 at the appropriate locations, the back plane 32 is perpendicular to the polarity axis 26. Rotating the antenna 12 about an axis perpendicular to the back plane 32 permits the polarity of the antenna to be adjusted without altering the directional satellite alignment.

The satellite alignment mechanisms includes a pair of elevation brackets 34 with locking bolts 36 that engage elevation slots 37 and are configured to allow adjustment of the elevation of the antenna. As shown in FIG. 2*b*, the polarity plate 30 include slots 38 formed in the back plane 32. The brackets 34 are attached to the polarity plate 30 via bolts 39 which engage slots 38 in the polarity plate 30 so as to allow the antenna to rotate about the polarity axis.

Although accepted in the industry, the use of the separately attached stamped polarity plate, such as shown in FIGS. 2*a* and 2*b*, has several drawbacks. First, the use of the additional components increases the cost of the antenna and assembly complexity. Separately formed components also decrease accuracy since fabrication tolerance errors for each component are added together, both in the angle of the back plane and the position at which the polarity plate is attached to the antenna. The separately attached plate also increases the number of mechanical stress points on the back of the antenna, and thus may reduce the performance and lifetime of the antenna under wind loads, particularly when the antenna is large. Additionally, care must be taken to ensure that when the antenna mount is assembled, the proper polarity plate 30 is attached. This is a particular concern when several antenna variations, perhaps having different dimensions and vertex locations are assembled in the same place or by the same personnel. If an improper back plane is attached, the error may not be noticed until after the antenna is fully assembled and installed, resulting in potentially costly repair.

Accordingly, it would be beneficial to provide an antenna arrangement which does not require the use of a separately mounted polarity plate.

It would also be advantageous to provide a molded antenna, such as a parabolic antenna, which includes integrally molded mounting components that are configured to provide the proper polarity plate without requiring the attachment of additional reference hardware.

SUMMARY OF THE INVENTION

According to the invention, a molded parabolic antenna is formed having a raised area on the back of the antenna which forms a plane at the proper angle for aligning the antenna system polarity to the satellites. This integrated polarity plate provides a surface to which antenna mounting brackets are attached and obviates the need for a separate polarity plate to be mounted on the antenna. According to a further aspect of the combined antenna polarity and elevation brackets are provided which include slots and scale indicators to permit accurate elevation and polarity adjustments to be made. Because the polarity and alignment slots and scales are formed on the same bracket, preferably with a center pivot, cumulative tolerance errors are reduced. When the antenna rotation setting is complete, the mounting brackets can be locked down to the integrally molded polarity plate with a clamping device or other securing mechanisms.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE PREFERRED EMBODIMENTS

Figure 1:
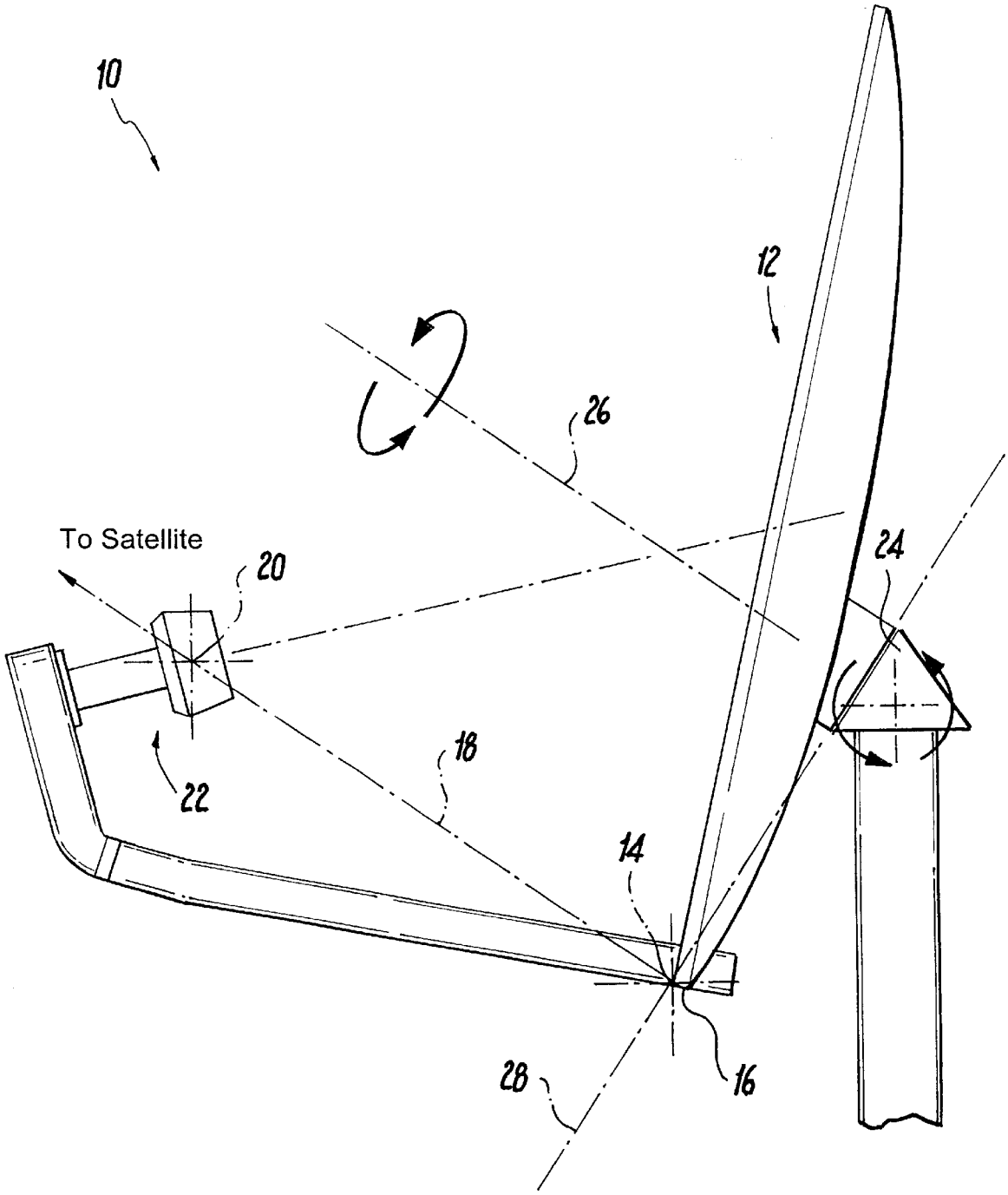
FIG. 1 (Prior Art)
FIG. 1 is an illustration of an offset parabolic antenna.
Figure 2A:
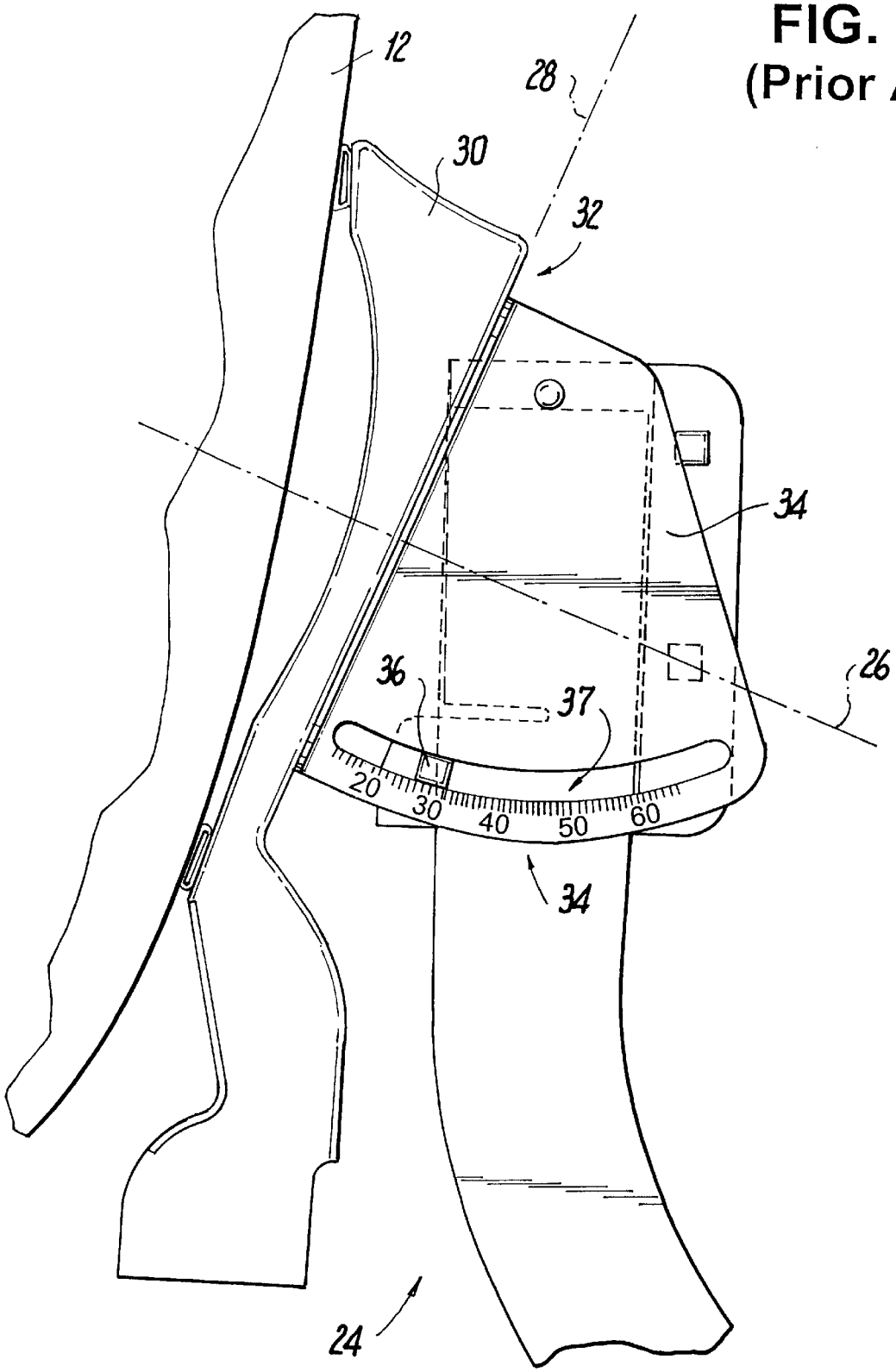
FIG. 2a (Prior Art)
FIGS. 2*a* and 2*b* are illustrations of a conventional mounting apparatus for an offset antenna.
Figure 2B:
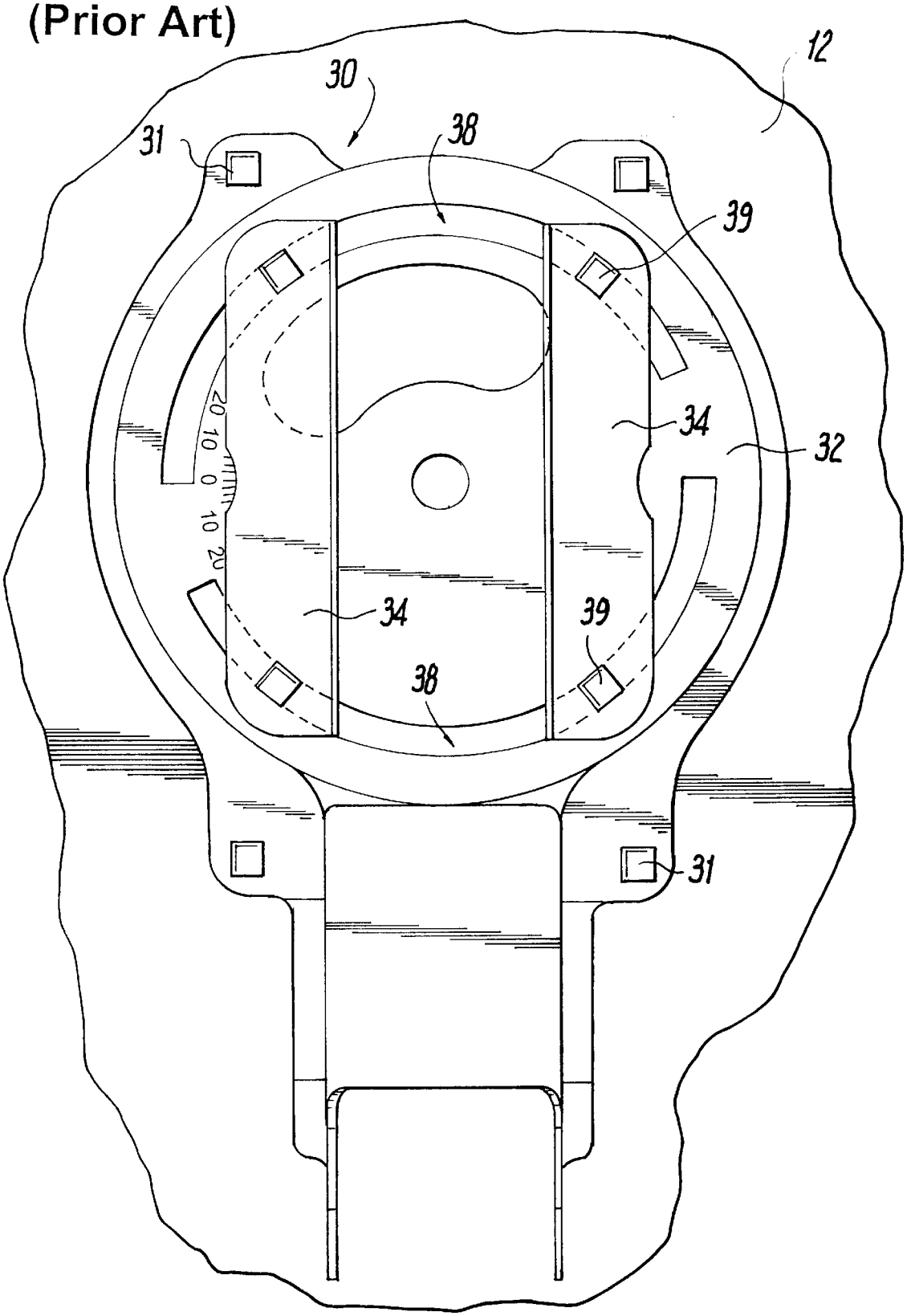
FIG. 2b (Prior Art)
Figure 3A:
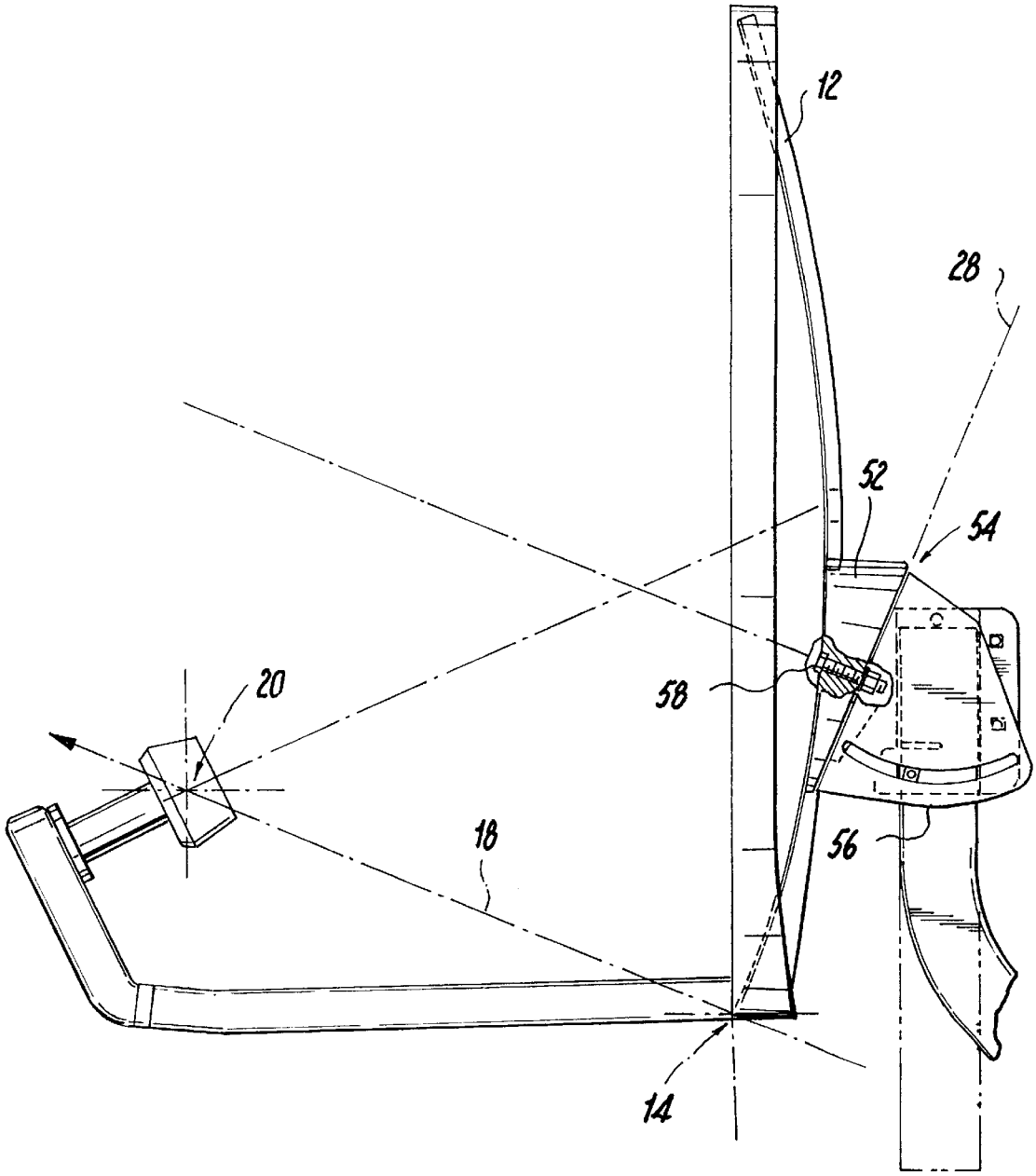
FIGS. 3*a* and 3*b* are side and back views, respectively, of an antenna including an integrally molded mounting apparatus according to the invention.
Figure 3B:
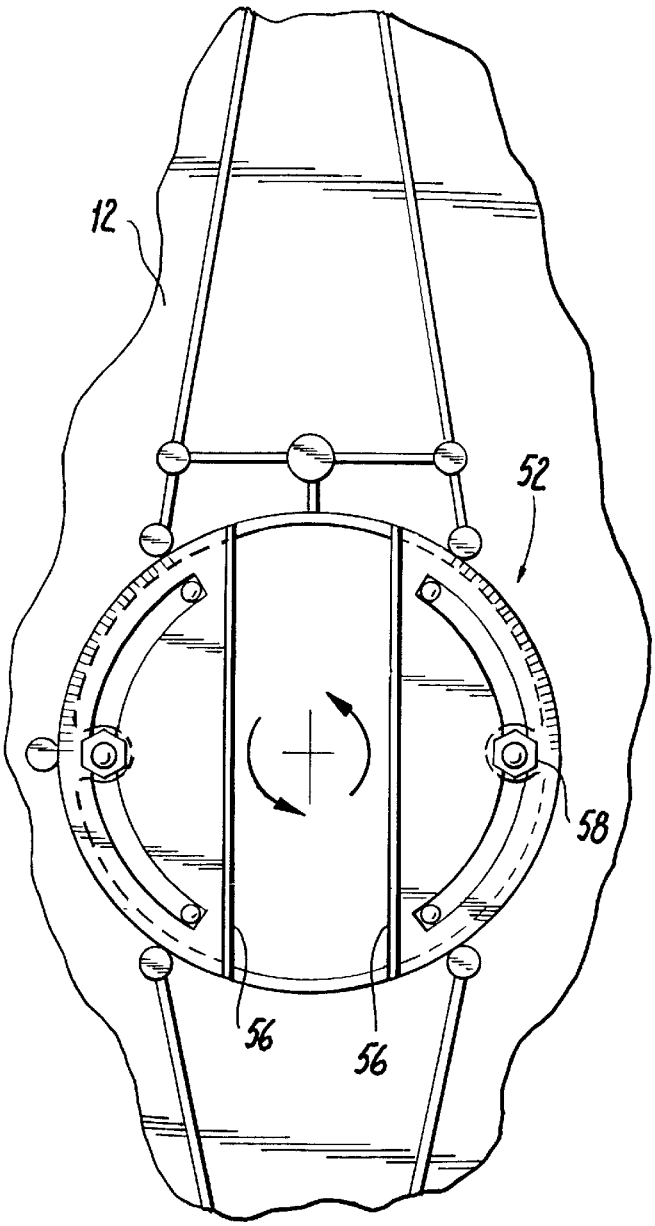

Turning to FIGS. 3*a* and 3*b* there are shown transparent side and back views, respectively, of an antenna mounting assembly 50 for an antenna, such as offset parabolic antenna 12. Antenna 12 has a vertex 14 which, together with focal point 20, defines a boresight access 18. A polarity plane 28 is tangent to the antenna at point 14, which is the parabolic vertex for a parabolic antenna and is perpendicular to boresight access 18.

An integrally molded polarity plate 52 having a back planar surface which is perpendicular to the polarity axis is formed on the back side of the antenna dish and is configured to receive the polarity and azimuth mount along the back planar surface. Although the back planar surface can cover the entirety of the molded polarity plate 52, preferably, it takes the form of an elevated ridge where the outwardly projecting edge of the ridge defines the planar surface and is configured to lie along a plane 54 which is substantially parallel to the polarity plane 28. Most preferably, the ridge is in a ring configuration. A pair of polarity and elevation brackets 56 are secured to ring 52 by a securing device, such as bolts 58, in a manner which allows the antenna to be rotated about an axis perpendicular to the plane 54, and therefore, the polarity plane 28.

Because the raised area defining plate 52 is integrally molded with the antenna 12, fewer components are required to mount the antenna, reducing manufacturing and assembly cost and increasing overall accuracy. The detailed components of the molded mounting apparatus 50 according to a preferred embodiment of the invention will now be discussed with reference to the remaining figures.

Figure 4A:
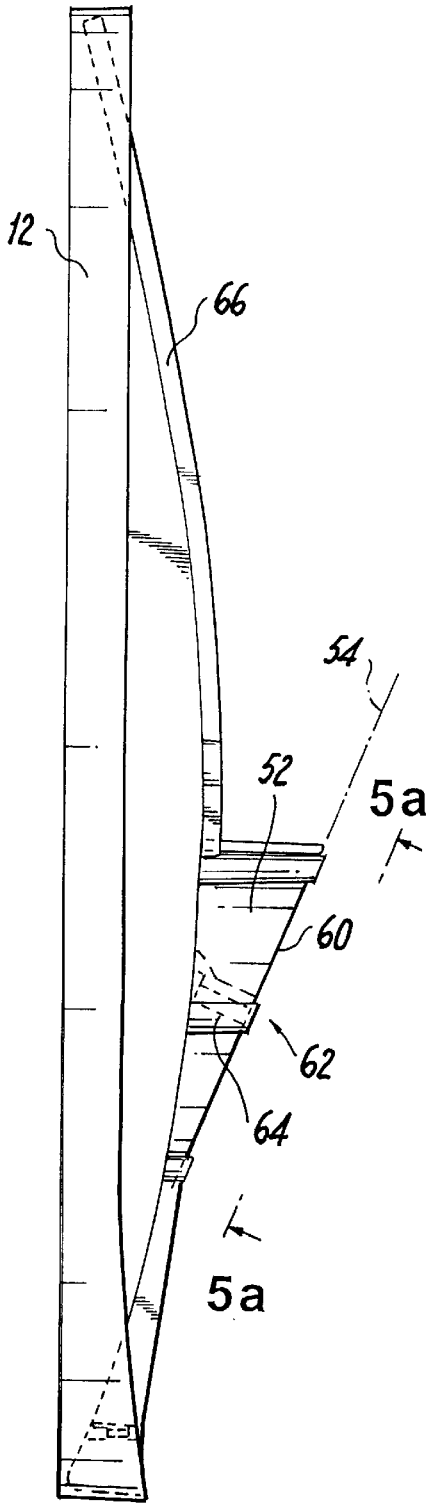
FIGS. 4*a*, 4*b*, and 4*c* are side, back, and front views, respectively, of the molded antenna of FIG. 3.
Figure 4B:
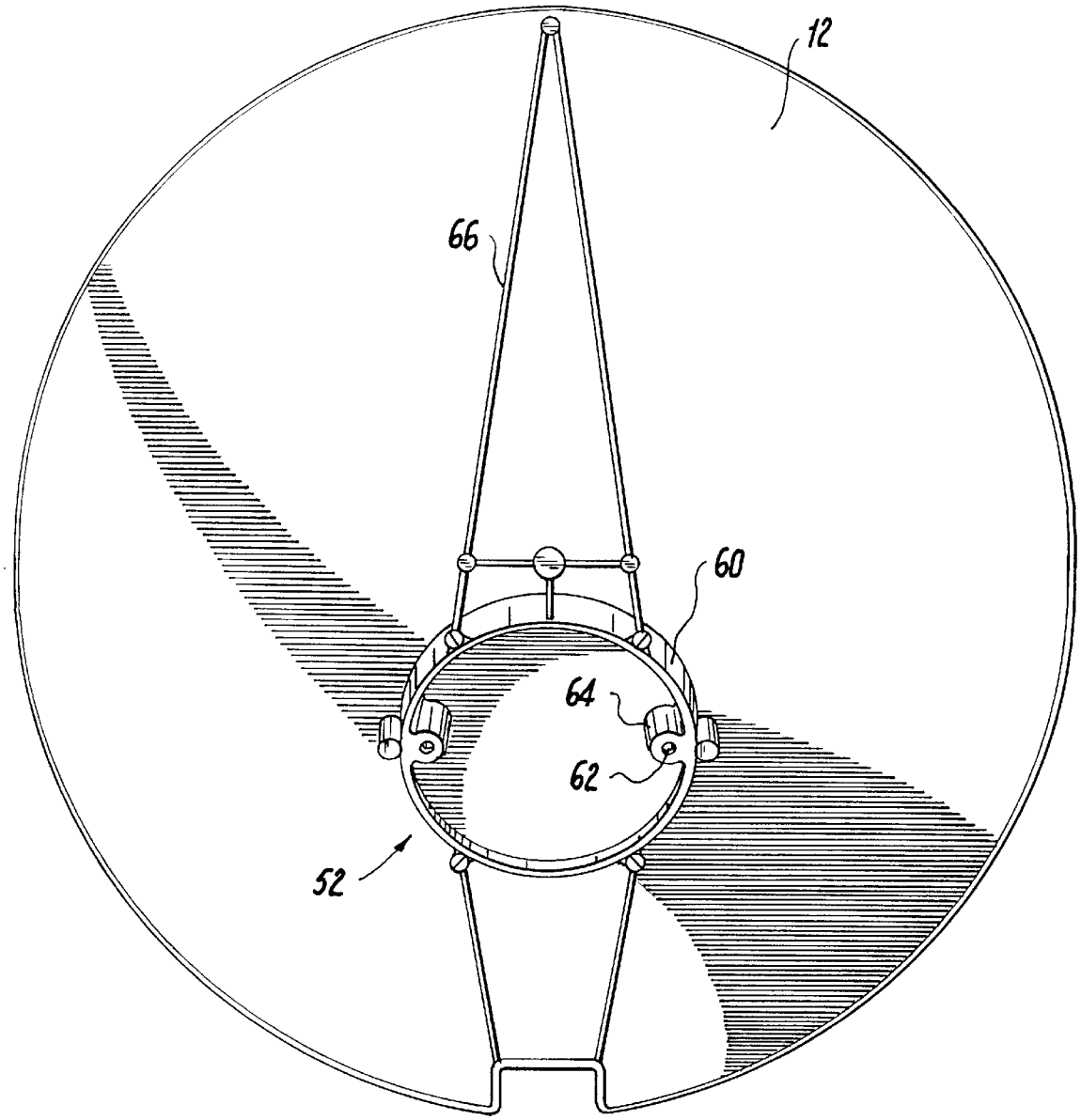
Figure 4C:
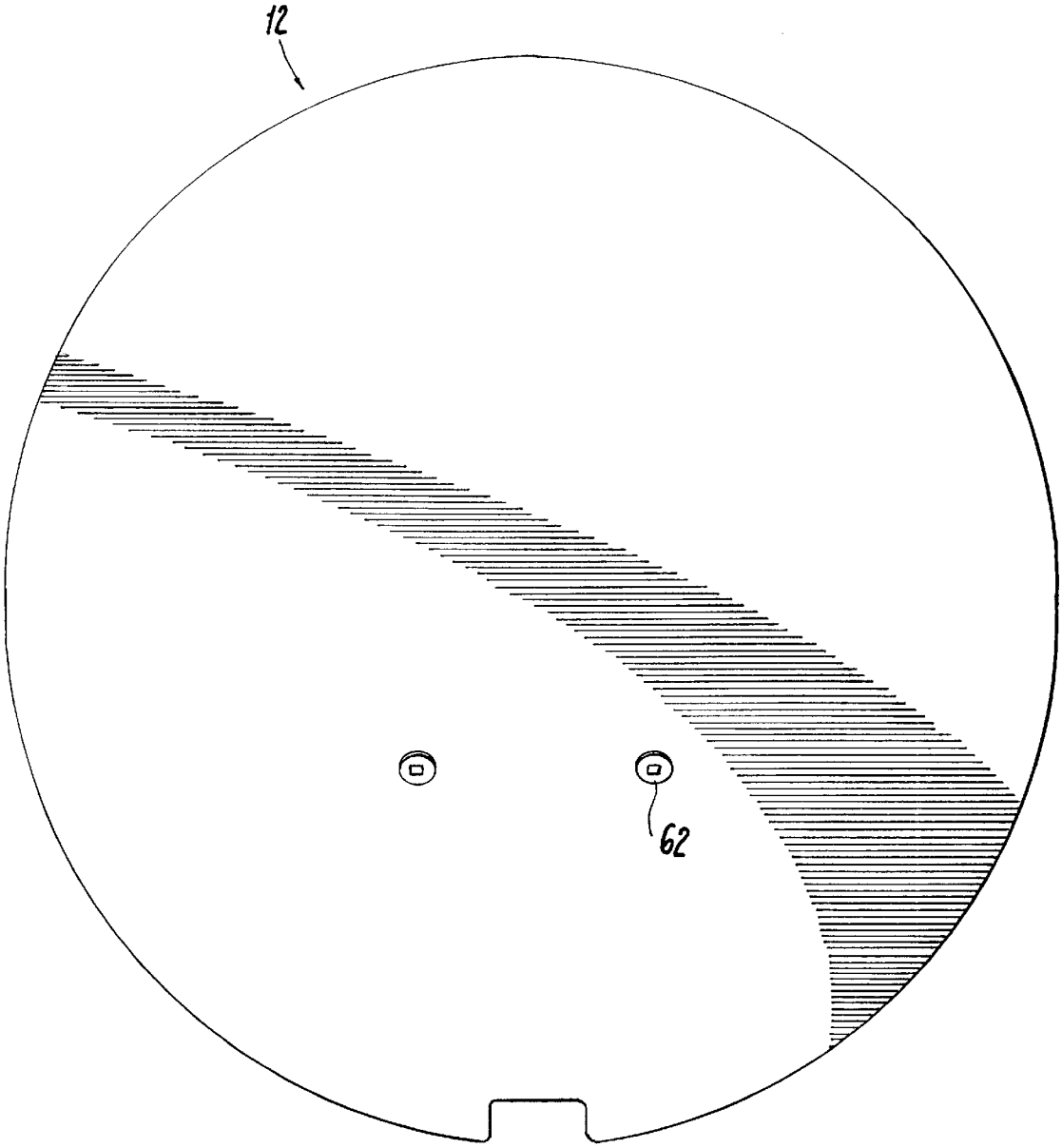

FIGS. 4*a, b*, and *c* illustrate side, back and front views, respectively, of a molded antenna 12 according to the invention. The antenna 12 includes an integrally molded ridge 52 having an outer edge 60 defining a back surface plane 54 which is parallel to the polarity 28 plane of antenna 12. One or more holes 62 and supporting bosses 64 are formed in the antenna adjacent and preferably within the molded ridge 52. The holes 62 for receiving mounting bolts 58 which are used to attach the polarity and elevation brackets 56 to the antenna. In a preferred embodiment, holes 62 extend through the antenna 12. However, the holes may be "blind" and receive self-tapping studs instead of bolts. Most preferably, two holes 62 with supporting bosses 64 are provided at opposite inner sides of the molded ring 52 as illustrated in the figure. Molded ribs 66 strengthen the antenna 12 and distribute the load forces.

Figure 5A:
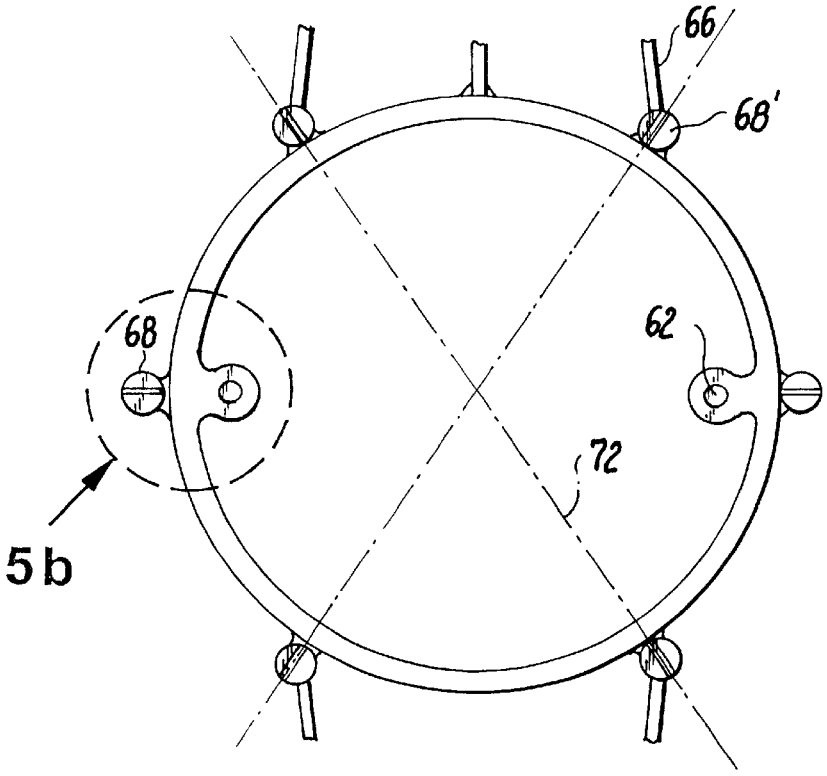
FIG. 5*a* is a back view of the integrally molded plate.
Figure 5B:
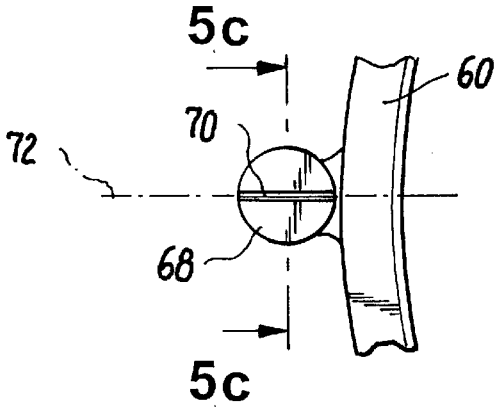
FIGS. 5*b* and 5*c* are top and side views, respectively, of a molded rib endpoint having antenna alignment marks.
Figure 5C:
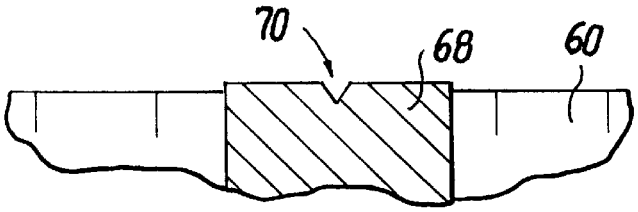

As shown in FIGS. 5*a*–5*c*, alignment guides 68 are positioned at various places around the molded ring, preferably adjacent each of the holes 62. Similar guides 68' can be placed at the ends of the ribs 66 adjacent the molded ridge 52. Alignment guides 68 and 68' have alignment marks to aid in setting polarity of the antenna. The guides arranged in predefined positions relative to an attached polarity and elevation brackets 56, discussed in more detail below, such as at the center and/or ends of the polarity slots when the slots are centered around holes 62.

An enlarged view of an alignment guide 68 is shown in FIG. 5*b*. FIG. 5*c* is a cross section of the guide 68 along line A—A. As illustrated, guides 68 are provided with alignment indicia 70, which is preferably a groove formed in the surface of guides 68. The alignment indicia 70 is most preferably a line lying on a diameter 72 of ridge 52.

The antenna 12 is preferably fabricated using a conventional molding processes and molding compounds. Preferably, with the exception for minor post-molding finishing, such as removing flashings and cleaning out the interior of holes 62, the entire assembly is made in a single molding step.

Figure 6A:
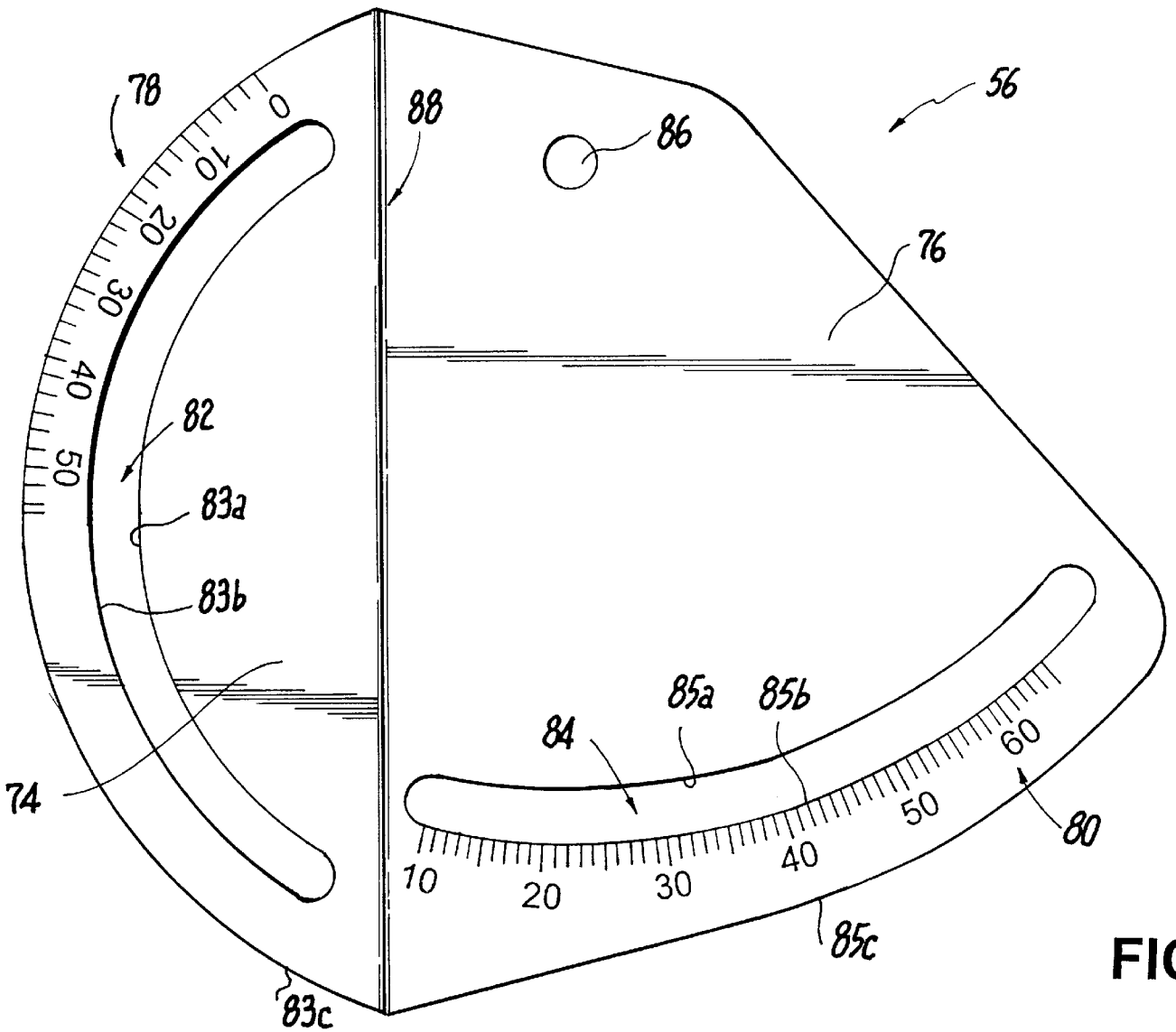
FIGS. 6*a*, 6*b*, and 6*c* are flattened, side, and top views, respectively, of combination polarity and elevation brackets.

FIG. 6*a* is an illustration of one embodiment of a flattened polarity and elevation bracket 56. In general, two brackets 56 are provided. However, in this embodiment, the brackets 56 are mirror-images of each other and so will not be separately discussed. The bracket 56, which can be formed of plate steel, or by molding, casting, or other techniques includes a polarity portion 74 and an elevation portion 76 generally separated by a boundary or fold line 88. The polarity portion 74 has a slot 82 with inner and outer edges 83*a*, 83*b*. At least one of the inner and outer edges 83*a*, 83*b* is arcuate. Preferably, both edges 83*a*, 83*b* are arcuate, defining an arc-shaped slot 82, and the circles defined by arcuate edges 83*a*, 83*b* have a common center point. However, only a single arcuate edge is generally required and slot 82 may take various configurations. Similarly, the elevation portion 76 has a slot 84 with inner and outer edges 85*a*, 85*b*. A hole 86 is formed in the elevation portion 76. At least one of the edges 85*a*, 85*b* lie along an arc of a circle having a center substantially corresponding to the position of hole 86. Preferably, both edges 85*a*, 85*b* are arcuate, defining arc shaped slot 84. Polarity angle indicia 78 can be formed adjacent one of the edges 83*a*, 83*b*. Elevation angle indicia 80 can be formed adjacent one of the edges 85*a*, 85*b*.

In one variation (not shown), slot 82 can be omitted completely and the outside edge 83*c* of the polarity portion 74 provided with an arcuate shape instead. Similarly, slot 84 can be is omitted completely and the outside edge 85*c* of the elevation portion 76 provided with an arcuate shape instead.

Figure 6B:
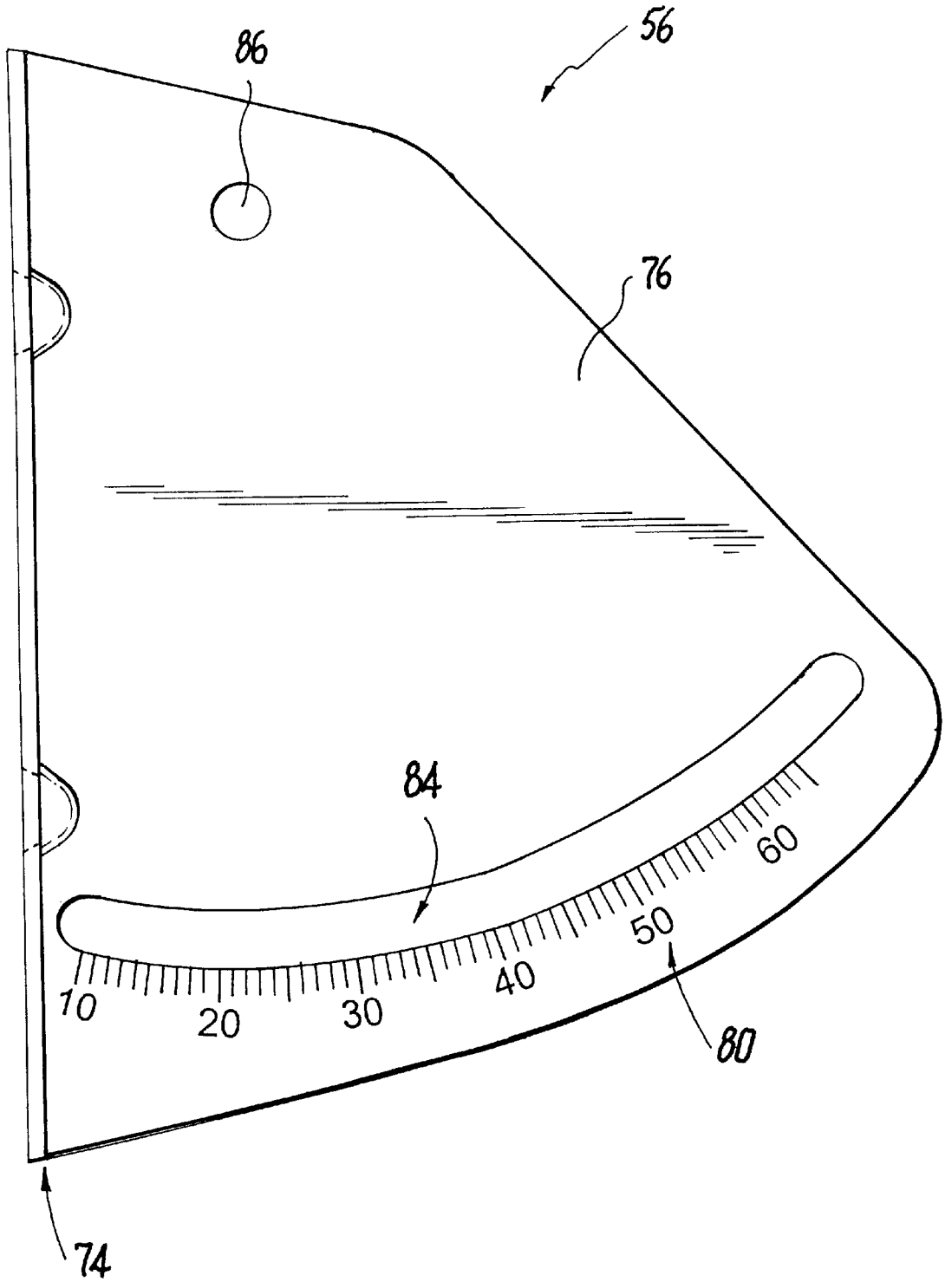
Figure 6C:
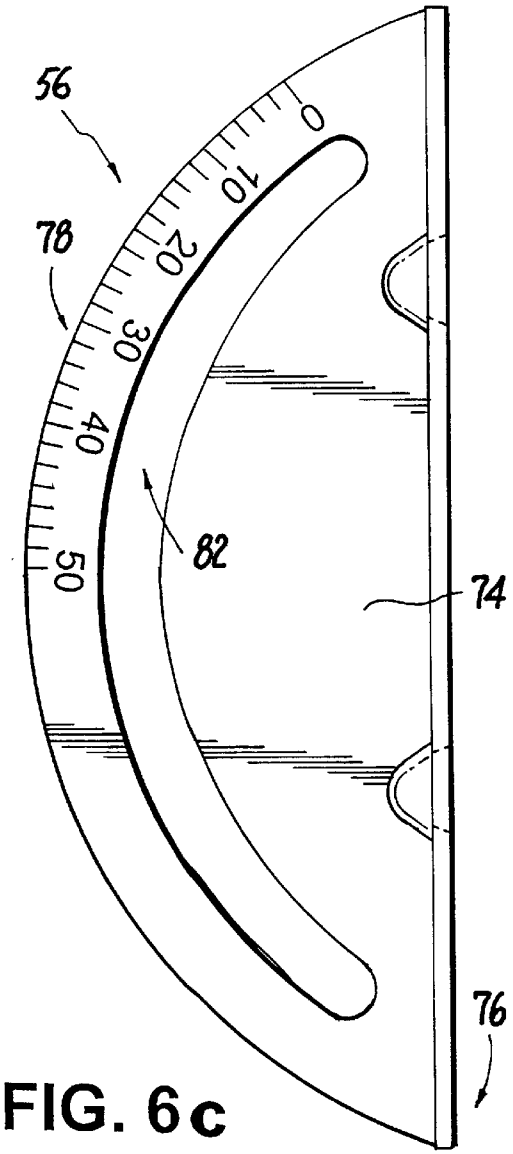

In its final form, the bracket 56 is folded substantially 90 degrees along fold line 88 and is generally L-shaped when viewed from the side. FIGS. 6*b* and 6*c* show side and top views of the final bracket 56. It should be recognized that actual folding is not required and the bracket 56 may be initially fabricated with the polarity and elevation portions 74, 76 at right angles to each other.

Figure 7A:
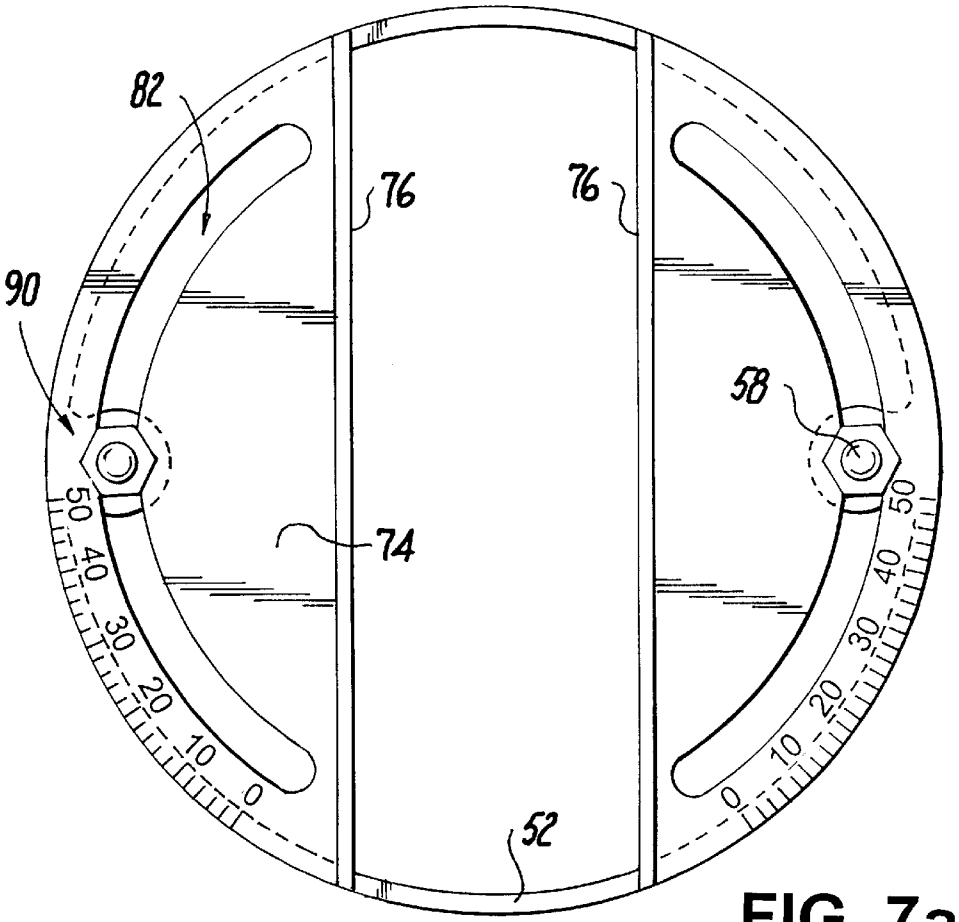
FIGS. 7*a* and 7*b* are a side and back views, respectively, of a molded ring polarity plate and mounted brackets.
Figure 7B:
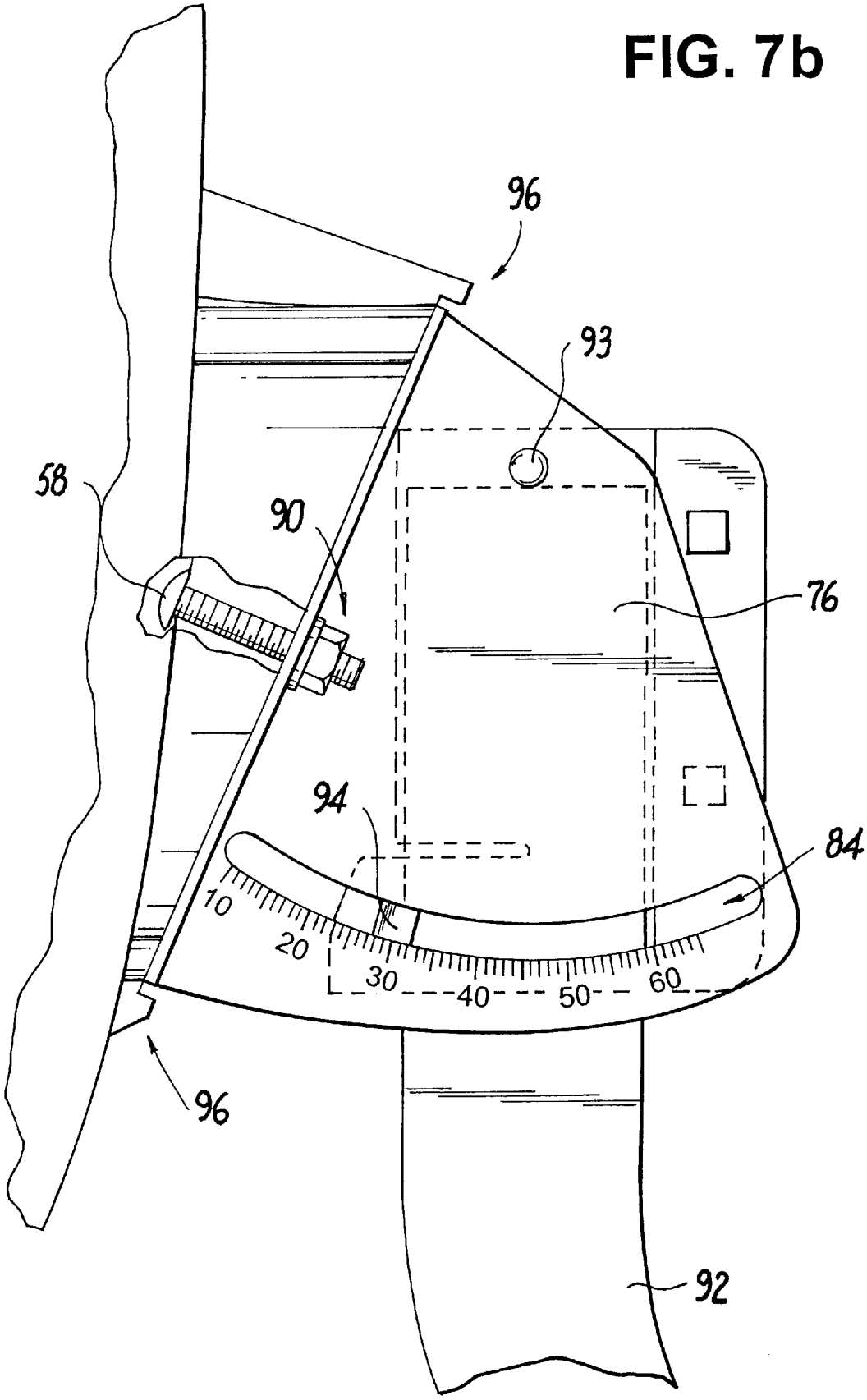

A back view of a secured bracket 56 is illustrated in FIG. 7*a*. A side view of a mounted antenna is illustrated in FIG. 7*b*. The L-shaped polarity and elevation bracket 56 is secured to the molded polarity plate e.g., by a bolt 58 which passes through the hole 62 in the antenna 12 and slot 82, adjacent the arcuate side(s) 83*a*, 83*b* in the polarity portion 74 of the bracket 56. The bolt is secured in place by a suitable mounting element 90, such as a cap or nut which, when tightened, engages one of the sides 83*a*, 83*b* to hold the bracket 56 in place. The second (mirror-image) bracket is secured to the other half of the planar ring 52 in a similar manner and aligned such that the elevation portions 76 are substantially parallel to each other.

As discussed above, at least one side 83*a*, 83*b* of slot 82 is arcuate. The bracket 56 is positioned and sized such that the center of the circle defined by the arcuate edge substantially corresponds to center of the molded planar ridge 52. The antenna and the elevation bracket assembly is attached to a mounting arm and azimuth clamp assembly 92 by a support bolt 93 which engages the holes 86 in the elevation portion 76 of the respective brackets.

An elevation locking bolt 94 passes through the slot 84 in the elevation portion 76 of each bracket 56. When the locking bolt 94 is loose, the bolt 94 can be moved within the slot 84. This permits the antenna to rotate about bolt 93 so that the elevation can be adjusted. When the proper elevation is achieved, the locking bolt 94 is tightened so that the bolt engages one or both of the edges 85*a*, 85*b* of slot 84, locking the antenna in place at the selected elevation. As can be appreciated, the polarity of the dish relative to the mounted brackets can be adjusted over the range that the bolt 58 can be slide within slot 82 along the arcuate edge(s) 83*a*, 83*b*. When the appropriate polarity has been achieved, the nut is tightened to retain the bracket in the desired location.

While the locking mechanism has been discussed herein in the form of a bolt and nut or cap, those of skill in the art will appreciate that other locking mechanisms which engage the appropriate arcuate edge(s) of the mounting bracket can be used instead. For example, various clamping or clipping fasteners can be provided. In one configuration, notches or serrations are formed along an arcuate edge and engage a locking ratchet mechanism. Other arrangement are also possible. These configurations are suitable for use with slots or free arcuate edges.

While the polarity portion 74 of the brackets 56 can have a variety of shapes, preferably, the polarity portion 74 generally corresponds to a portion of a circle having an approximate diameter equal to the diameter of the planar ring 52. Although not required, in one arrangement, the planar ridge 52 is ring shaped and formed with an outer ledge 96, as shown in FIG. 7*b*. The polarity portion 74 of the brackets 56 fits inside the outer ring formed by ledge 96. This configuration provides for a more accurate placement of the brackets as the ledge serves to limit the amount of play between the bolt 58 and the slot 82 and serves as a secondary guide for the brackets 56.

Figure 8B:
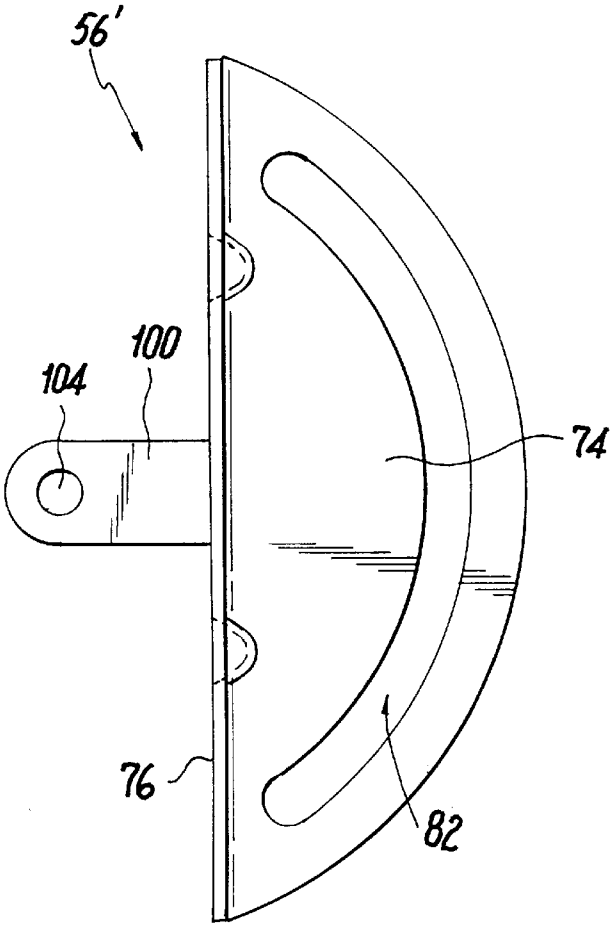
FIGS. 8*a* and 8*b* are flattened and top views, respectively of a second embodiment of the combination polarity and elevation brackets.
Figure 8A:
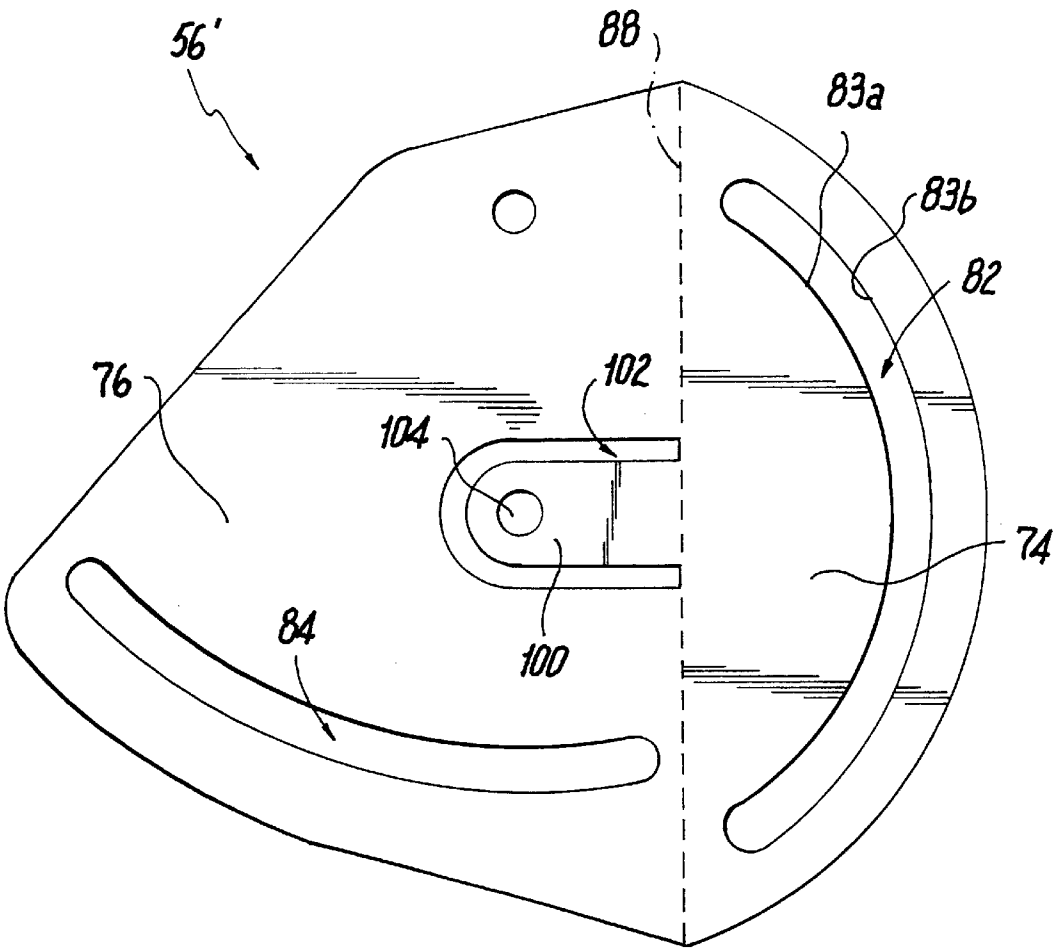

FIG. 8*a* is an illustration of a second embodiment of a flattened polarity and elevation bracket 56'. Bracket 56' is generally similar to bracket 56, discussed above, with the addition of a hole 104 which is positioned at the center of the circle defined by arcuate edges 83*a*, 83*b* associated with slot 82. Preferably, the hole 104 is positioned on a tab 100 extending beyond the fold line 88 from the polarity portion 74 and into the elevation portion 76. Such a tab can be formed by means of a U-shaped cut or slot 102 as shown. As shown in FIG. 8*b*, when the bracket 56' is folded along fold line 88, tab 100 forms an extension of the polarity portion 74 beyond the elevation portion 76.

Figure 9A:
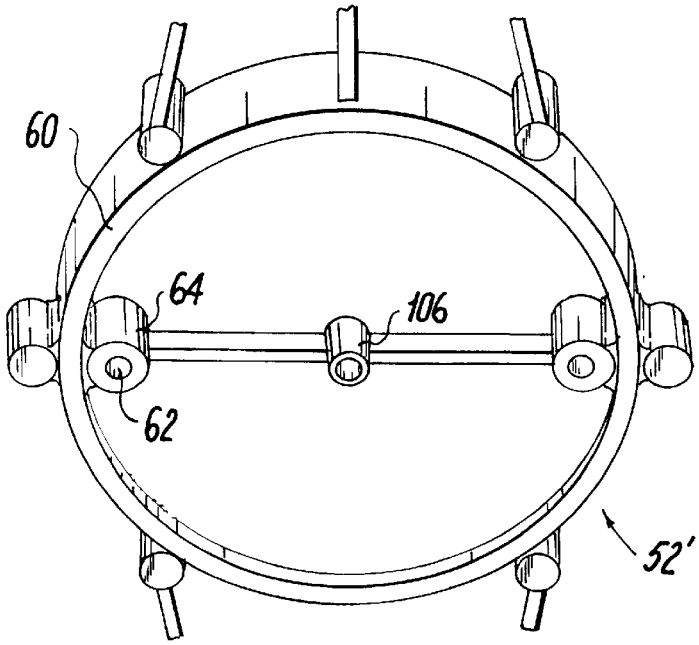
FIG. 9*a* is a back view of the integrally molded plate of FIG. 5*a* modified to receive the brackets of FIGS. 8*a* and 8*b;*
Figure 9B:
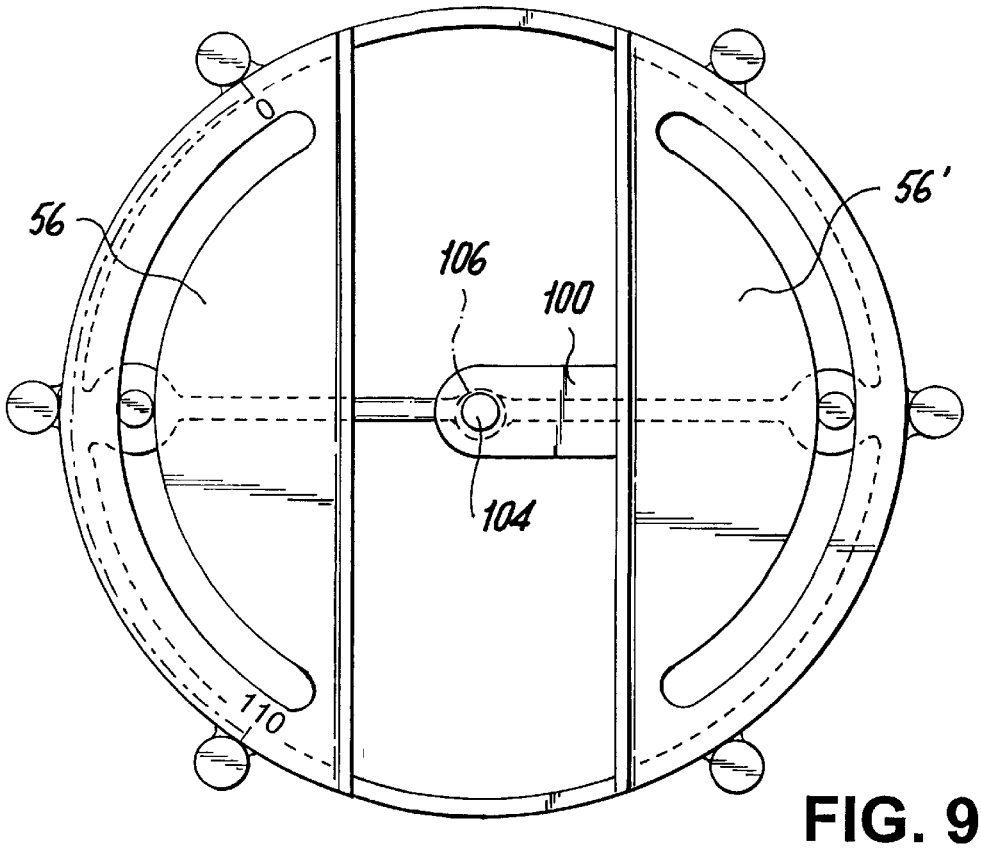
FIG. 9*b* is a back view of the molded ring of FIG. 9*a* with a mounted brackets as shown in FIGS. 8*a* and 8*b;*

FIG. 9*a* is an illustration of a modified ring 52' which includes a centrally located pivot pin 106. The hole 104 in polarity portion 74 is configured to snugly fit over the pivot pin 106 extending from the center of the planar ring 52'. The pivot pin limits the amount of play between the mounting bolts and the slots. In addition, the pin provides an additional pivot point for the brackets 56' to reduce binding during rotation and also prevent "wiggling" of the mounted antenna. FIG. 9*b* is a back view of a bracket 56 and bracket 56' secured on a mounting ring 52' having center pivot 106. As shown in this figure, only one of the brackets 56' is provided with a tab 100. The second bracket 56 is secured only via the mounting bolts. Alternatively, both brackets can have a respective tab 100. In this arrangement, one or both of the tabs should be bent so that the tabs can rest over each other and the brackets still mount flush with the ring 52'.

In yet another alternative configuration, the center boss 106 is sized to permit a bracket to be mounted with a single polarity clamping and pivot fastener 110. This permits a bracket to be attached to the antenna at a single point, reducing the number of mounting components required. One embodiment of this alternative configuration is illustrated in FIGS. 10*a–d*.

Figure 10A:
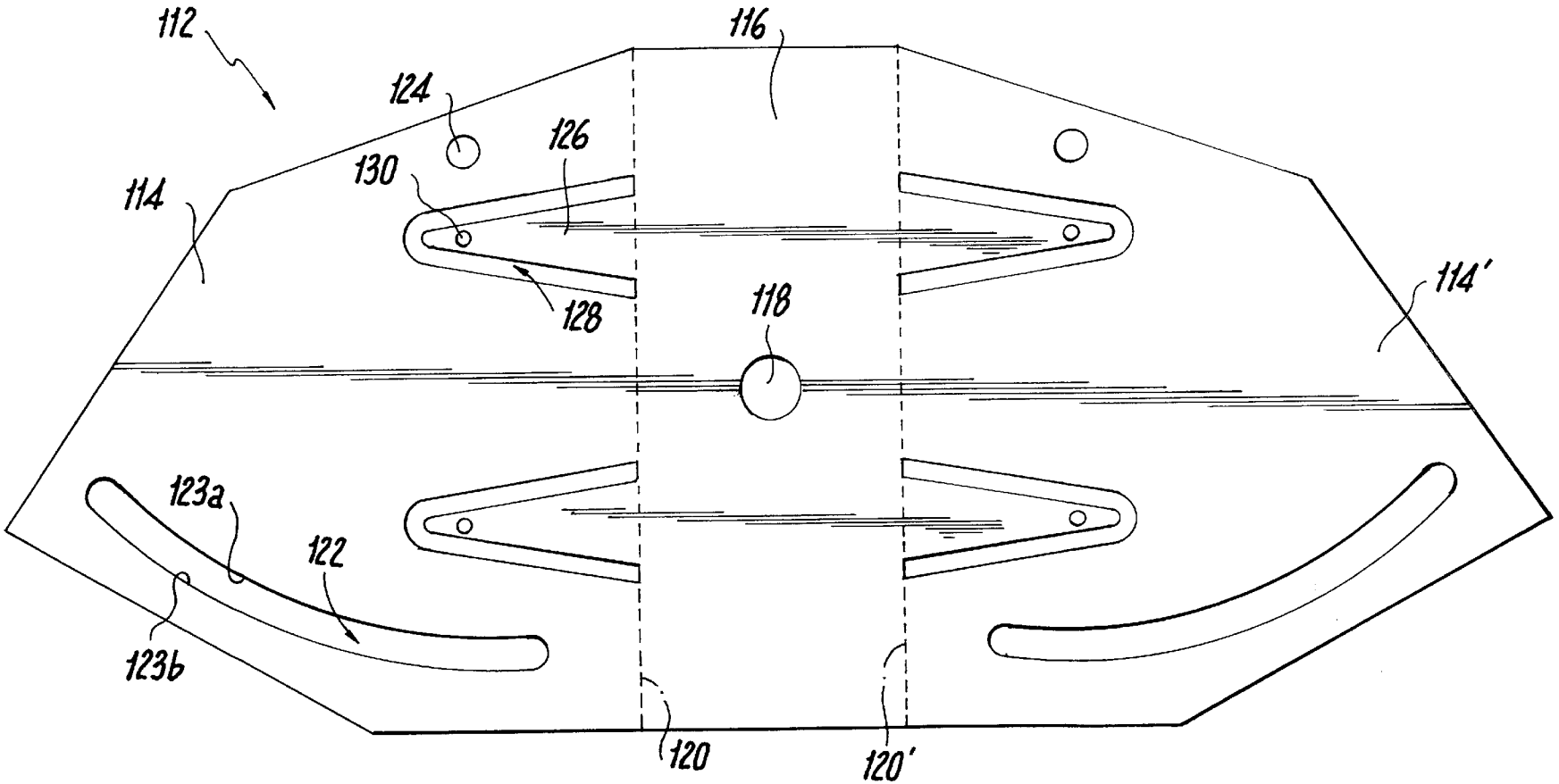
FIG. 10*a* is a flattened view of a second embodiment of a mounting bracket.

In this embodiment, the two-component bracket is replaced by a modified integral bracket member 112, shown in flattened form in FIG. 10*a*. The bracket member 112 has a left elevation portion 114 and a right elevation portion 114'. The left and right elevation portions 114, 114' are separated by a central region 116 generally bounded by border lines 120, 120' as shown. The right elevation portion 114' is substantially a mirror image of the left elevation portion 114' and so only the left portion will be discussed.

The left elevation portion contains a slot 122 with inner and outer edges 123*a*, 123*b*. A hole 124 86 is formed in the elevation portion 114 such that at least one of the edges 123*a*, 123*b* lie along an arc of a circle having a center substantially corresponding to the position of hole 124. Preferably, both edges 123*a*, 123*b* are arcuate and define an arc shaped slot 122. Elevation angle indicia can be formed adjacent one of the edges 123*a*, 123*b*. As discussed above, the slot 122 can be omitted completely and the outside edge provided with an arcuate shape instead.

In use, the left and right elevation portions 114, 114' are positioned parallel to each other and at right angles of the central region 116. This may be accomplished by bending the bracket 112 along boundary lines 120, 120'. The bracket can then be mounted to the center boss 106 of the antenna by a polarity clamping and pivot fastener 110 which passes through hole 118 and engages boss 106 as shown in FIG. 10*d*. To adjust the polarity, fastener 110 is loosened to permit the bracket 112 to rotate relative to the antenna.

Figure 10B:
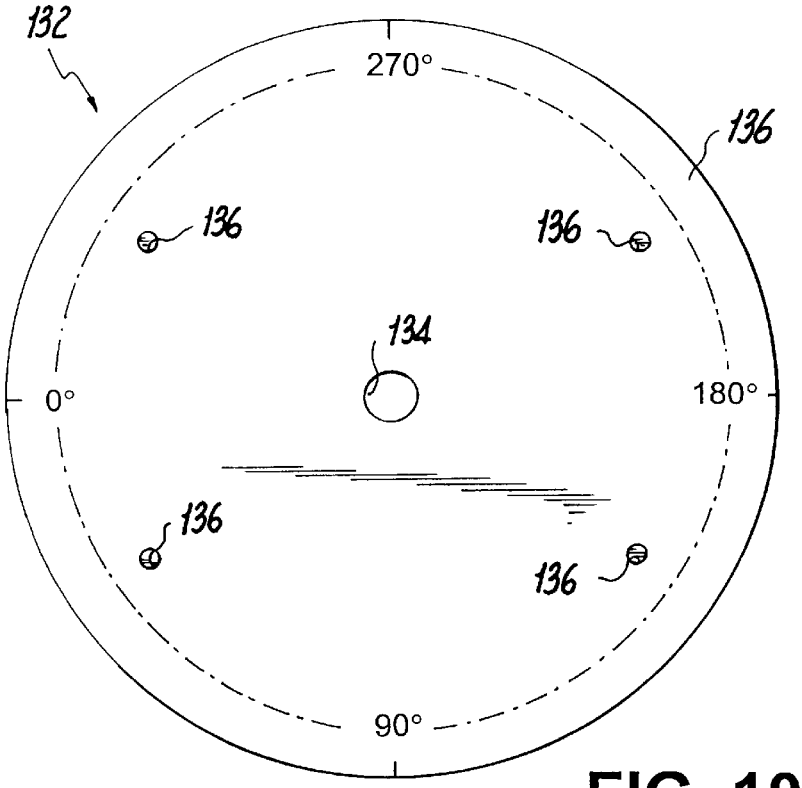
FIG. 10*b* is an illustration of a polarity wheel for use with the bracket of FIG. 10*a*.
Figure 10C:
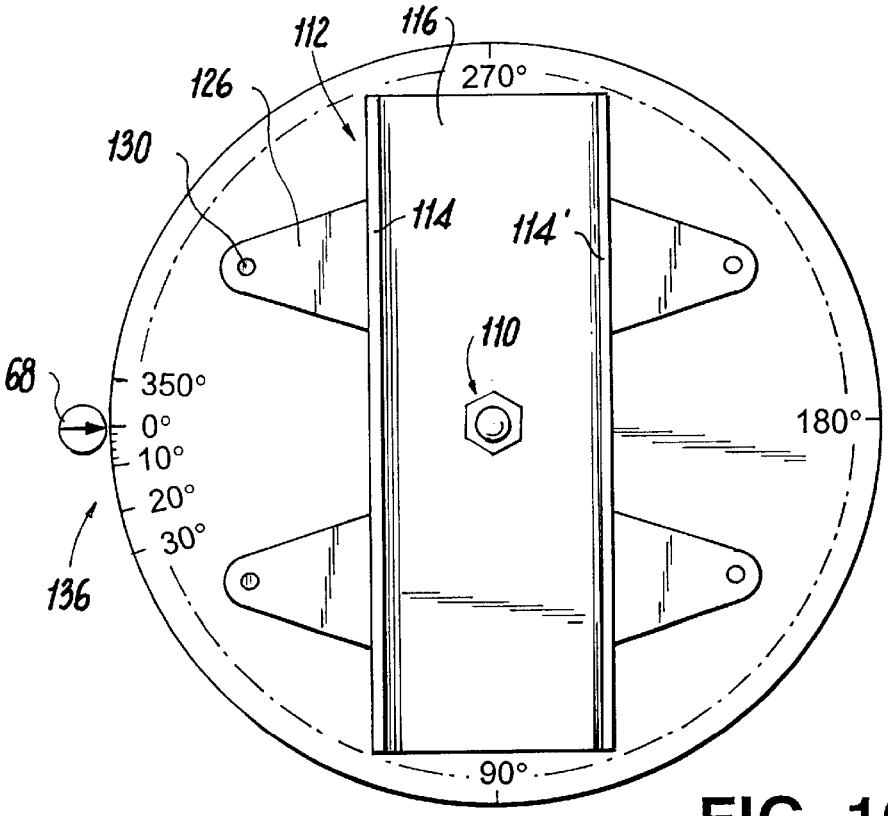
FIGS. 10*c* and 10*d* are views of the bracket of FIG. 10*a* and the polarity wheel of FIG. 10*b* mounted on an antenna.
Figure 10D:
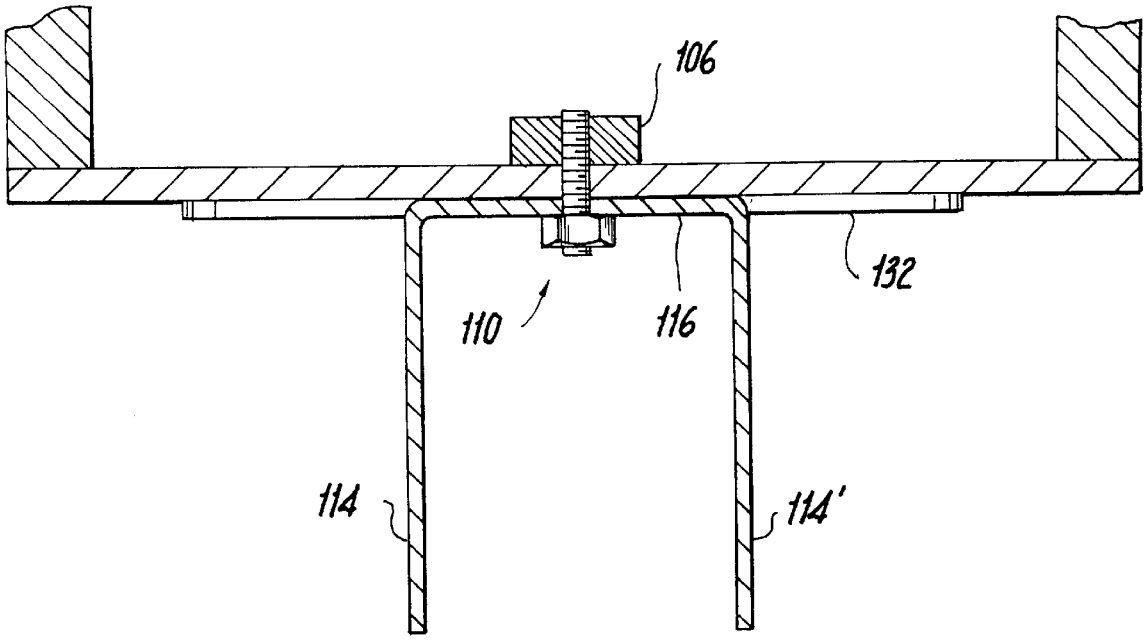

To provide a clearer indication of the polarity of the antenna, bracket 112 is preferably mounted in conjunction with a polarity wheel 132 shown in FIG. 10*b*. The polarity wheel 132 is a disk-shaped sheet having a central hole 134 and polarity indicia 136. The polarity wheel 132 is mounted between the antenna and the bracket 112 such that fastener 110 passes through hole 134 as shown in FIGS. 10*c* and 10*d*.

To ensure that the bracket 112 is in a fixed position with respect to the polarity indicia 136 on wheel 132, the bracket 112 can be affixed to wheel 132. Preferably, the central region 116 of bracket 112 has one or more tabs 126 which extend beyond the boundary lines 120, 120' and into the left and right polarity portions 114, 114'. Such tabs can be formed by means of U-shaped cuts or slots 128 as shown in FIG. 10*a*. When the bracket 112 is bent into position, tabs 126 extend outwards as best shown in FIG. 10*c*. Holes 130 are formed in tabs 126 and corresponding pins 136 are formed in wheel 132 which engage holes 130 when the bracket is properly positioned on the wheel 132. (An opposite configuration is also possible, as are the use of holes in both the wheel and tab and screws to hold the two components in place relative to each other). In this manner, the wheel 132 will rotate in conjunction with the bracket 112, permitting accurate polarity angle determinations to be made.

While the invention has been particularly shown and described with reference to the preferred embodiments thereof, it will be understood by those skilled in the art that various changes in form of details may be made therein without departing from the spirit and scope of the invention. For example, while the preferred embodiments have been discussed with reference to a parabolic antenna, the mounting configuration of the invention can also be used with other satellite and terrestrial antenna types, such as shaped multi-beam antennas and flat antennas.

What is claimed is:

1. An antenna disk suitable for attachment on a mount permitting adjustment of antenna azimuth, elevation and rotation of the antenna disk about a polarity axis, the antenna comprising:

a molded antenna having a front and a back side; and an integrally molded polarity plate formed on the back side of the antenna and configured to receive said mount;

the integrally molded polarity plate having a back planar surface perpendicular to the polarity axis.

2. The antenna disk of claim 1, wherein the back planar surface is defined by an elevated ridge.

3. The antenna disk of claim 2, wherein said ridge is generally ring shaped.

4. The antenna disk of claim 1, wherein the antenna has at least one hole therein proximate the polarity plate for receiving a mounting bolt to attach the mount to the polarity plate.

5. The antenna disk of claim 1, further comprising integrally molded antenna alignment guides situated adjacent a periphery of the polarity plate.

6. The antenna disk of claim 1, further comprising a pivot pin extending from substantially a midpoint of the polarity plate.

7. A polarity and elevation bracket for use in mounting an antenna in a manner permitting adjustment of an elevation angle of the antenna and an angle of polarity rotation, the bracket comprising:

a unitary member having a polarity portion and an elevation portion generally meeting along a boundary line;

the polarity portion having a first arcuate edge for adjusting the angle or polarity;

the elevation portion having an elevation hole therein and a second arcuate edge lying along a circle having a center substantially corresponding to the position of the elevation hole for adjusting the angle of elevation.

8. The bracket of claim 7, wherein said polarity portion has a polarity slot therein defining said first arcuate edge and said elevation portion has an elevation slot therein defining said second arcuate edge.

9. The bracket of 8, further comprising elevation angle indicia proximate the elevation slot and polarity angle indicia proximate the polarity slot.

10. The bracket of claim 7, wherein the polarity portion has a polarity pivot hole therein positioned at substantially the center of a circle defined by the first arcuate edge.

11. The bracket of claim 10, wherein the polarity portion has a tab extending beyond the boundary line, the polarity pivot hole being situated in the tab.

12. The assembly of claim 11, wherein the polarity portion has a tab extending beyond the boundary line, the polarity hole being situated in the tab.

13. An antenna and mounting assembly permitting azimuth adjustment of antenna elevation and rotation of the antenna about a polarity axis comprising:

a molded antenna having a front and a back side;

an integrally molded polarity plate formed on the back side of the antenna and configured to receive said mount, the integrally molded polarity plate having a back planar surface perpendicular to the polarity axis;

said antenna having at least one mounting hole therein proximate the polarity plate;

at least one unitary bracket having a polarity portion and an elevation portion generally separated by a boundary line the polarity portion and the elevation portion being substantially perpendicular to each other;

the polarity portion having a polarity slot therein;

the elevation portion having an elevation hole therein and an arcuate elevation slot lying along a circle having a center substantially corresponding to the position of the elevation hole;

a first mounting member engaging the mounting hole and polarity slot and securing the bracket to the polarity plate, wherein an angle of rotation of the antenna about the polarity axis relative to the bracket can be adjusted by adjusting the position of the mounting member within the polarity slot;

said bracket being mountable to an antenna azimuth clamp support by a second mounting member engaging the elevation hole and a locking bolt engaging the elevation slot; the elevation of the supported antenna relative to the antenna support being determined by the position of the locking bolt within the elevation slot.

14. The assembly of claim 13, wherein the polarity plate has a pivot pin extending therefrom;

the polarity portion of the bracket having a polarity hole therein positioned at substantially the center of a circle defined by the polarity arc for receiving the pivot pin when the bracket is mounted to the polarity plate.

15. A polarity and elevation bracket for use in mounting an antenna in a manner permitting adjustment of an elevation angle of the antenna and an angle of polarity rotation, the bracket comprising:

a unitary member having left and right elevation portions separated by a central region, the left elevation portion generally meeting the central region along a first boundary line, the right elevation portion generally meeting the central region along a second boundary line;

said left and right elevation portions each having an elevation hole therein and an arcuate edge lying along a circle having a center substantially corresponding to the position of the elevation hole;

said central region having a pivot hole therein for asjusting the angle or polarity.

16. The bracket of claim 15, wherein said left and right elevation portions each have an elevation slot therein defining said arcuate edge.

17. The bracket of claim 15, wherein the central region has at least one tab extending beyond said first boundary line and at least one tab extending beyond said second boundary line;

the bracket further comprising a polarity wheel having a mounting hole therein;

each said tab having a hole therein, the polarity wheel having a plurality of extensions each in alignment with and engaging a respective hole in a respective tab when said bracket is mounted on said polarity wheel.

* * * * *